United States Patent [19]

Bruninga

[11] 4,432,495

[45] Feb. 21, 1984

[54] POP-UP SPRINKLER WITH INDEPENDENTLY BIASED DRAIN VALVE

[75] Inventor: Kenneth J. Bruninga, Mapleton, Ill.

[73] Assignee: L. R. Nelson Corporation, Peoria, Ill.

[21] Appl. No.: 376,496

[22] Filed: May 10, 1982

[51] Int. Cl.[3] ..... B05B 15/10

[52] U.S. Cl. ..... 239/205; 239/206; 239/575

[58] Field of Search ..... 239/203, 204, 205, 206, 239/570, 575

[56] References Cited

U.S. PATENT DOCUMENTS

| | | | |
|---|---|---|---|
| 2,611,644 | 9/1952 | Burdick | 299/61 |
| 2,705,663 | 4/1955 | Gilbreath | 239/575 |
| 3,033,467 | 5/1962 | Hofer | 239/204 |
| 3,258,205 | 6/1966 | Hruby | 239/204 |
| 3,637,139 | 1/1972 | Felix | 239/206 |
| 3,758,038 | 9/1973 | Ridgway | 239/206 |
| 3,921,910 | 11/1975 | Hayes et al. | 239/205 |
| 4,026,471 | 5/1977 | Hunter | 239/206 |
| 4,164,324 | 8/1979 | Bruninga | 239/230 |
| 4,171,775 | 10/1979 | Unruh | 239/206 |

*Primary Examiner*—John J. Love
*Assistant Examiner*—Jon M. Rastello

[57] ABSTRACT

An improvement in a pop-up sprinkler which comprises the provision of an upwardly facing annular valve seat in the lower portion of the housing assembly above the inlet therein and a valve member on the pop-up sprinkler head assembly in a position to engage the annular valve seat when the sprinkler head assembly is in its retracted storage position. The valve member is mounted on the sprinkler head assembly for biased movement independent of the movement of the sprinkler head assembly and the bias thereof provided by its weight and the return coil spring thereof so that the valve member will be separately moved out of engagement with the annular valve seat to permit passage of water under pressure into the housing assembly in response to the communication of the source of water under pressure with the inlet.

8 Claims, 4 Drawing Figures

POP-UP SPRINKLER WITH INDEPENDENTLY BIASED DRAIN VALVE

This invention relates to sprinkling systems for lawns, athletic fields, golf courses and the like, and more particularly to improvements in pop-up sprinklers utilized in such systems.

It is often the case when installing the individual pop-up sprinklers of a sprinkler system in a lawn or similar area that a series of pop-up sprinklers which are interconnected together will be mounted so that one of the pop-up sprinklers is at a vertical level below the other sprinklers in the series. Under these conditions, when the water is turned off to complete the sprinkling cycle and the pop-up sprinkler heads retract into their inoperative positions, the water in the system will drain by gravity into the lowermost sprinkler. In many instances this flow may result in the creation of a standing puddle of water in the ground area surrounding the lowermost sprinkler. Such standing water can have a deleterious effect upon the lawn growth in the flooded ground area.

The expired patent literature contains the disclosure of a pop-up sprinkler which provides a valving action preventing drainage of water from the pop-up sprinkler head when the latter moves into its retracted inoperative position. See, for example, U.S. Pat. No. 2,611,644. Other patents of interest in this respect are as follows: U.S. Pat. Nos. 3,033,467; 3,258,205; 3,637,139; 3,758,038; 4,026,471; and 4,171,775.

The valve arrangement depicted in U.S. Pat. No. 2,611,644 consists simply of a valve member formed as a fixed lower part of the sprinkler head riser structure which, when the riser structure is spring biased into its retracted inoperable position, serves to seat against a fixed annular valve seat formed in the entrance tube of the stationary housing of the pop-up sprinkler. While the arrangement of the expired prior art provides the advantage of structural simplicity, there exists a significant disadvantage in that in order to initially open the valve the water pressure acting thereon must overcome the bias provided by the weight of the sprinkler head riser assembly and the bias provided by the riser return spring. The strength of the return spring is chosen as a function of the differential pressure area of the riser structure which is acted upon by the water to effect the pop-up movement of the riser assembly taking into account the weight or the gravity effect of the riser assembly itself. Because the pressure area of the valve on which the water can initially act is necessarily a minor percentage of the differential area of the riser structure, this simplistic arrangement of the expired prior art may result in there being insufficient line pressure to cause the riser assembly to be initially moved into a valve opening position where the line pressure is reduced for some reason or a greater lifting force is required for some reason, as, for example, a dried mud seal between the housing upper rim and the top plate of the riser assembly.

It is an object of the present invention to provide an improved valve arrangement for a pop-up sprinkler of the type described which provides for valve opening in response to the communication of line pressure therewith with a force which is independent of and less than the force required to overcome the weight of the riser assembly and the bias of the return spring thereof.

In accordance with the principles of the present invention this objective is achieved by providing an upwardly facing annular valve seat in the lower portion of the housing assembly above the inlet therein and a valve member on the pop-up sprinkler head assembly in a position to engage the annular valve seat when the sprinkler head assembly is in its retracted storage position. The valve member is mounted on the sprinkler head assembly for biased movement independent of the movement of the sprinkler head assembly and the bias thereof provided by its weight and the return coil spring thereof so that the valve member will be separately moved out of engagement with the annular valve seat to permit passage of water under pressure into the housing assembly in response to the communication of the source of water under pressure with the inlet.

Another object of the present invention is the provision of an improved valve assembly in a pop-up sprinkler of the type described which is mounted within the lower end of the sprinkler head assembly by means of a molded strainer which serves to coarse filter all of the water discharging from the sprinkler head assembly.

Another object of the present invention is the provision of a pop-up sprinkler of the type described having an improved valve means therein which is simple in construction, economical to manufacture and effective in operation.

These and other objects of the present invention will become more apparent during the course of the following detailed description and appended claims.

The invention may best be understood with reference to the accompanying drawings, wherein an illustrative embodiment is shown.

Figure 1:
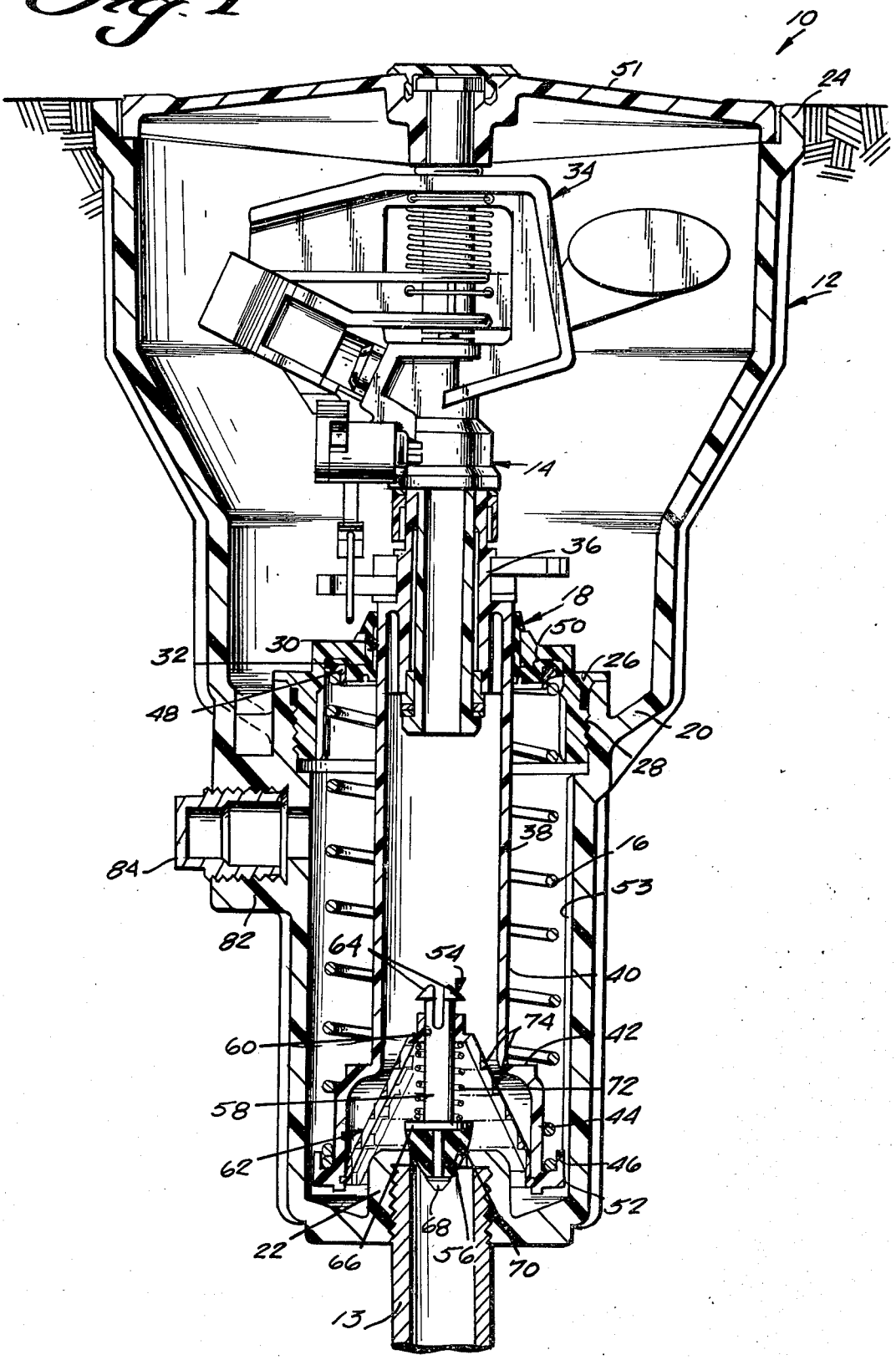
FIG. 1 is a vertical sectional view of a pop-up sprinkler embodying the principles of the present invention, the pop-up sprinkler head assembly being shown in its retracted storage position with the improved valve assembly of the present invention in sealing relation to its seat.

Referring now more particularly to the drawings, there is shown in FIG. 1 thereof a pop-up sprinkler, generally indicated at 10, embodying the principles of the present invention. The pop-up sprinkler 10 includes a housing assembly, generally indicated at 12, which is adapted to be installed within the ground so that its upper end is substantially level with the surface of the ground and the remainder extends downwardly therefrom. The lower end of the housing assembly 12 is connected to a supply pipe 13 through which a controllable source of water under pressure is communicated with the interior of the housing assembly 12. A sprinkler head assembly, generally indicated at 14, normally disposed in a retracted storage position within the housing assembly as shown in FIG. 1, is adapted to extend into an operative position in response to the communication of the water source. A coil spring 16 is provided between the two assemblies to insure that the sprinkler head assembly 14 retracts into its storage position when the communication of the water source is closed off. The pop-up sprinkler 1 also includes a multiple purpose seal assembly, generally indicated at 18, which is cooperatively engaged with the housing assembly 12, sprinkler head assembly 14 and coil spring 16.

It will be understood that the housing assembly 12 may assume any desired configuration. As shown, the housing assembly 12 includes a first housing member 20 of generally elongated cup-shaped configuration, preferably molded of a suitable material such as plastic or the like. The first housing member has a lower end portion formed with an interiorly threaded tubular inlet section 22 for connection with the supply pipe 13 as shown, and an open upper end portion terminating in an upwardly extending annular flange 24 which, as shown, provides an upwardly facing flat annular surface disposed in a radial plane with respect to the vertical axis of the housing member 20. The housing assembly 12 also includes a second interior housing member 26 which includes a tubular sleeve portion formed with exterior threads 28 adapted to threadedly engage cooperating interior threads formed on the central interior portion of the first housing member 20. The second housing member 26 also includes a radially inwardly extending flange portion which terminates in a generally cylindrical interior surface 30. The flange portion of the member 26 includes a downwardly facing surface 32 extending radially from the sleeve portion to the cylindrical surface 30. As shown, the surface 32 is a flat recessed annular surface disposed in a radial plane.

The sprinkler head assembly 14 may likewise assume any desirable configuration. As shown, the sprinkler head assembly 14 includes a part-circle rotary impact sprinkler head 34 although it will be understood that other known sprinkler head types are contemplated, such as spray heads, etc. The part-circle rotary impact head 34 is rotatably mounted within an upper sleeve 36 integrally formed as an upper integral part of a larger tubular member 38. The tubular member 38 includes a cylindrical exterior periphery 40 of a size slightly less than the interior cylindrical surface 30. The periphery 40 extends from a position adjacent the center of sleeve 36 downwardly throughout a major portion of the tubular member 38 and terminates in a radially outwardly extending upwardly facing surface 42. The surface 42 is formed on the upper end of an enlarged downwardly opening lower end portion 44 of the member 38 which terminates in a radially outwardly extending flange 46. The upwardly facing surface of the flange 46 provides a lower seat for the spring 16.

The upper end of the coil spring 16 is seated on a spring retainer 48 forming a part of the seal assembly 18. The seal assembly 18 also includes a resilient sealing element 50 which is disposed in engagement with the surfaces 30 and 32 of the housing member 26. The sealing assembly 18 provides all of the functions attributable to the seal assembly disclosed in commonly assigned U.S. Pat. No. 3,921,910, the disclosure of which is hereby incorporated by reference into the present specification. It will be understood that in lieu of the two-piece seal assembly 18, the one-piece assembly of the patent may be utilized if desired.

The details of construction of the part-circle rotary impact sprinkler head 34 do not form any part of the present invention. The construction shown is in accordance with commonly assigned U.S. Pat. No. 4,164,324, the disclosure of which is hereby incorporated into the present specification. It will be noted, however, that a top cover plate 51 is mounted on the upper end of the sprinkler head in a position to close within flange 24 in the upper end of the housing when the sprinkler head assembly is in its retracted storage position, as shown in FIG. 1.

Any suitable means may be provided for maintaining the annular orientation of the tubular member 38 of the sprinkler head assembly 14 during the movement thereof between the retracted storage position and the elevated operating position thereof so that the selected part-circle ground pattern of the head 34 will remain fixed. As shown, flange 46 is provided with a plurality of circumferentially spaced guide lugs 52 integrally formed on the outer periphery thereof. One or more of the guide lugs 52 are disposed between cooperating pairs of axially extending guide ribs 53 formed on the interior periphery of the first housing member 20.

Figure 2:
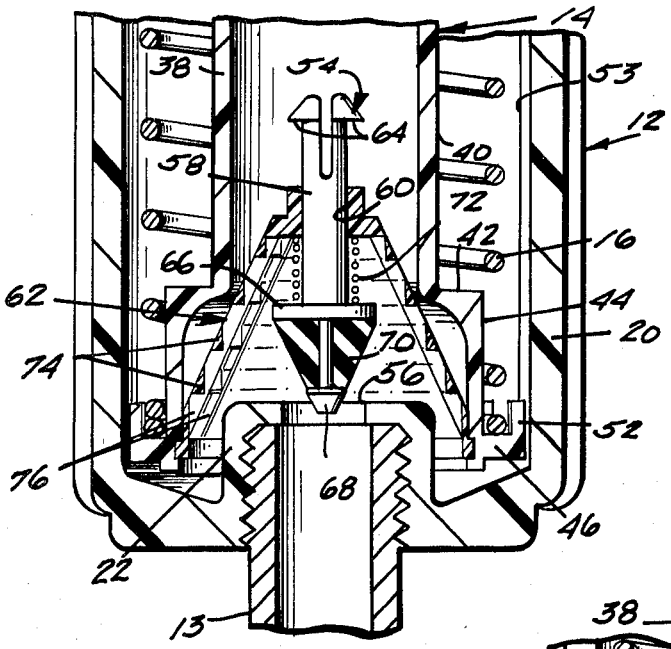
FIG. 2 is a fragmentary sectional view of the lower portion of the sprinkle shown in FIG. 1 with the improved valve assembly of the present invention shown in the open position which it assumes upon initial communication of the sprinkler with water under pressure.
Figure 3:
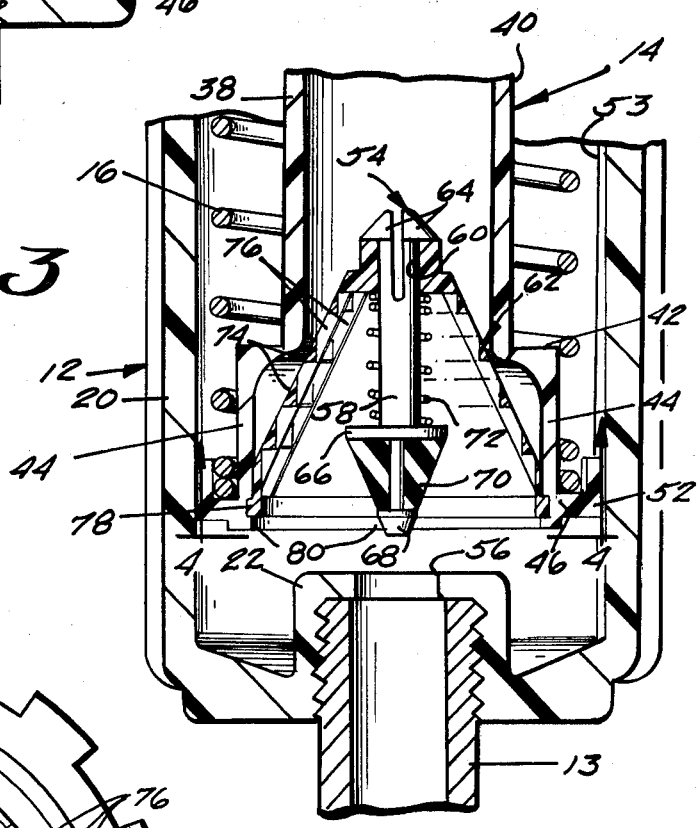
FIG. 3 is a view similar to FIG. 2 showing the position of the improved valve assembly of the present invention after the sprinkler head riser assembly has commenced its upward movement.

The present invention is more particularly concerned with the provision of an improved independently biased drainage valve member, generally indicated at 54. The valve member 54 is mounted within the enlarged lower end portion 44 of the tubular member 38 of the sprinkler head assembly 14 and is adapted to sealingly engage an upwardly facing annular valve seat 56 formed on the upper end of the lower inlet section 22 of the housing member 20. As best shown in FIGS. 1–3, the valve member 54 is formed in part by a cylindrical valve stem 58 which is mounted within a cylindrical opening 60 formed in the upper apex portion of a conically shaped strainer, generally indicated at 62. The upper end of the valve stem 58 is bifurcated and formed into a pair of oppositely directed barbs 64 capable of yieldably moving toward one another in response to an upward insertional movement of the valve stem 58 within the cylindrical opening 60 and of moving away from one another after passage through the cylindrical opening to form stops engageable with the apex portion of the strainer 62 so as to define a lower limiting position of the valve member 54.

Figure 4:
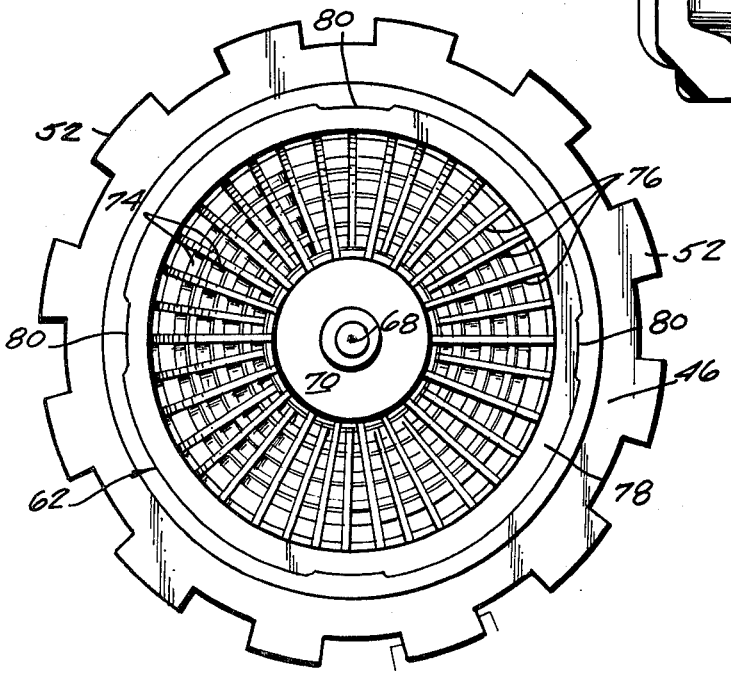
FIG. 4 is an enlarged fragmentary sectional view taken along the line 4—4 of FIG. 3.

Valve stem 58 has an annular flange 66 formed on the lower end thereof which, in turn, has a headed shank 68 extending downwardly therefrom. A generally frustoconical shaped valve element 70 of resilient material forming another part of the valve member 54 is snapped into a position surrounding the headed shank 68 between the head thereof and the annular flange 66. The exterior periphery of the valve element 70 is generally frustoconical as shown and serves to provide sealing engagement with the upwardly facing annular valve seat 56. The valve member 54 is resiliently biased into its lower limiting position by means of a coil spring 72 which is of a strength substantially less than the strength of the return coil spring 16 for the pop-up sprinkler head assembly 14. As best shown in FIG. 4 of the drawings, strainer 62 is preferably molded of a flexible plastic material as, for example, polyethylene. The main conically shaped body thereof is formed by a series of exterior annular rings 74 of upwardly decreasing diameters rigidly retained in vertically spaced relation by a series of interior annularly spaced ribs 76. Also as best shown in FIG. 4, the interior of the enlarged tubular portion 44 of the tubular member 38 is recessed to receive the lower exterior periphery of the strainer 62 which is in the form of an annular radially outwardly extending flange 78. The interior periphery of the lower enlarged tubular portion 44 is provided with a plurality of annularly spaced radially inwardly projecting tabs 80 which serve to retain the strainer 62 within the lower end of the tubular member 38. The strainer is radially movable into secured relation with respect to the tabs by a simple upward yielding movement.

FIG. 1 illustrates the position of the drain valve member 54 when the sprinkler 10 is properly installed as a part of a system and the source of water under pressure for the system is turned off. It will be noted that the housing 20 provides an auxiliary lateral inlet section 82 which, as shown, is closed by a removable plug 84. In the installation of the system, plug 84 may be removed from the lateral inlet 82 and placed in the lower inlet 22 where the particular mount of the sprinkler within the system is at an upper elevation with respect to the other sprinklers of the system. In accordance with the principles of the present invention, however, it is desirable to have those sprinklers 10 which are positioned at the lowermost levels within the system mounted so that the water under pressure of the system is communicated with the lower inlet 22 with plug 84 closing the lateral inlet 82.

It will be noted that the strength of the main return coil spring 16 for the pop-up sprinkler head assembly 14 is sufficient together with the weight of the latter to cause the latter to be moved into and maintained in the retracted storage position shown in FIG. 1 wherein the drainage valve member 54 is disposed in sealing engagement with the annular valve seat 56 and the valve spring 72 is slightly flexed with stops 64 slightly spaced from their engaged limiting position. When the main source of water under pressure is turned on and the water pressure communicates with the inlet section 22 through inlet pipe 13, the water pressure acting on the exposed area of the valve member 54 creates an upward resultant force thereon which readily overcomes the force of the light spring 72 and the relatively inconsequential weight of the valve member 54 itself. Consequently, the valve member is moved into an open position, as shown in FIG. 2, allowing the water under pressure to enter into the interior of the housing assembly 2 and to fill the same as well as to pass through the strainer and into the sprinkler head assembly 14. This water pressure acts on the resultant pressure area defined by the seal assembly 18 (less the discharge opening of the sprinkler head 34) to effect movement of the sprinkler head assembly 14 upwardly into its elevated operative position against the bias of spring 16 and the weight of the sprinkler head assembly 34 itself. It will be noted that the effective pressure area which effects the raising of the sprinkler head assembly 14 is considerably greater than the effective area which serves to raise the drainage valve member 54 from its seat 56. It can be seen from FIG. 3 that as the sprinkler head assembly 14 begins to rise from its retracted storage position, the valve spring 72 is operable to bias the drainage valve member 54 into its lower limiting position wherein barbs 64 provide a stop function.

After an appropriate period of operation has taken place and the main water supply is cut off it will be noted that the reduction in the water pressure will allow the bias of return spring 16 together with the weight of the sprinkler head assembly 14 to effect a downward movement of the latter from its elevated operating position toward its retracted storage position. Again, it will be noted that during the final part of the downward movement of the sprinkler head assembly 14, valve member 54 will engage valve seat 56, at which point movement of the valve member 54 with the sprinkler head assembly 14 ceases and the latter then moves slightly downwardly into its final storage position. The engagement of the valve member 54 with seat 56 prevents the drainage of water in the system at a level above the valve seat 56 from draining into the interior of the housing assembly 12, outwardly therefrom through the sprinkler head discharge opening, past cover plate 52 and onto the surrounding ground area. The normal pressures of the operating system are substantially greater than the pressures resulting from the drainage system. The strength of spring 72 is chosen so that it will retain drainage valve member 54 in engagement with its seat 56 under the relatively low drainage head pressures contemplated while yielding to permit the valve member 54 to lift off of seat 56 under normal operating pressures.

It thus will be seen that the objects of this invention have been fully and effectively accomplished. It will be realized, however, that the foregoing preferred specific embodiment has been shown and described for the purpose of illustrating the functional and structural principles of this invention and is subject to change without departure from such principles. Therefore, this invention includes all modifications encompased within the spirit and scope of the following claims.

What is claimed is:

1. In a pop-up sprinkler comprising a housing assembly adapted to be stationarily mounted in the ground having an inlet in the lower portion thereof adapted to be communicated with a source of water under pressure, a sprinkler head assembly carried by said housing assembly for movement from a retracted storage position into an extended opertive position in response to the communication of said water source with said housing assembly, and coil spring means between said housing assembly and said sprinkler head assembly for resiliently urging said sprinkler head assembly into said retracted storage position in response to the closing of communication of said water source with said housing assembly, the improvement which comprises an upwardly facing annular valve seat formed in the lower portion of said housing assembly above said inlet therein, a valve member carried by said sprinkler head assembly in a position to engage said annular valve seat when said sprinkler head assembly is in said retracted storage position, and means mounting said valve member on said sprinkler head assembly for biased movement independent of the movement of said sprinkler head assembly and independent of the resilient urging of said coil spring means so that said valve member will be separately moved out of engagement with said annular valve seat prior to the movement of the sprinkler head assembly out of said retracted storage position so as to permit passage of water under pressure into said housing assembly in response to the communication of the source of water under pressure with said inlet.

2. The improvement as defined in claim 1 wherein said mounting means serves to mount said valve member on said sprinkler head assembly for vertical translational movement and includes a light coil spring of a strength less than the strength of said sprinkler head assembly coil spring means for resiliently biasing said valve member into a lower limiting position.

3. The improvement as defined in claim 2 wherein said valve member is moved slightly against the bias of said light coil spring when disposed in engagement with said annular valve seat.

4. The improvement as defined in claim 1, 2 or 3 wherein said valve member when in engagement with said annular seat has an effective area presented to the water under pressure in said inlet which is less than the effective area of said sprinkler head assembly presented to the water under pressure within said housing assembly when said sprinkler head assembly is out said storage position.

5. The improvement as defined in claim 1, 2 or 3 wherein said valve member includes a cylindrical valve stem and said mounting means comprises a conically shaped strainer having an upper apex portion defining a cylindrical opening slidably receiving said cylindrical valve stem, said strainer being positioned within said sprinkler head assembly such that all of the water under pressure passes through said strainer before being discharged therefrom.

6. The improvement as defined in claim 5 wherein said conically shaped strainer includes a series of exterior annular rings of upwardly decreasing diameters rigidly retained in vertically spaced relation by a series of interior annularly spaced ribs.

7. The improvement as defined in claim 5 wherein the upper end of said valve stem is formed with a pair of spaced oppositely directed barbs capable of yieldably moving toward one another in response to an upward insertional movement of said valve stem within said cylindrical opening and of moving away from one another after passage through said cylindrical opening to form stops engageable to determine said lower limiting position.

8. The improvement as defined in claim 5 wherein said strainer is secured along its lower periphery with said sprinkler head assembly by inwardly projecting tabs on the latter, said lower periphery being yieldably moved past said tabs into said secured relation.

* * * * *